US011419372B2

(12) United States Patent
Cheung

(10) Patent No.: US 11,419,372 B2
(45) Date of Patent: Aug. 23, 2022

(54) CLOTHING BACK BUCKLE, BRA CONNECTOR AND BRA

(71) Applicant: KAIPING LEADTHEWAY HOOK & EYE TAPE LTD., Kaiping (CN)

(72) Inventor: Suilung Cheung, Kaiping (CN)

(73) Assignee: KAIPING LEADTHEWAY HOOK & EYE TAPE LTD., Kaiping (CN)

( * ) Notice: Subject to any disclaimer, the term of this patent is extended or adjusted under 35 U.S.C. 154(b) by 67 days.

(21) Appl. No.: 16/913,316

(22) Filed: Jun. 26, 2020

(65) Prior Publication Data

US 2021/0120895 A1 Apr. 29, 2021

(30) Foreign Application Priority Data

Apr. 26, 2019 (CN) ..... 201910344807.X
Apr. 26, 2019 (CN) ..... 201920595009.X

(51) Int. Cl.
*A41F 1/00* (2006.01)

(52) U.S. Cl.
CPC ..... *A41F 1/006* (2013.01)

(58) Field of Classification Search
CPC ..... A41F 1/06
USPC ..... 450/28
See application file for complete search history.

(56) References Cited

U.S. PATENT DOCUMENTS 7,128,635 B1 * 10/2006 Liu ..... A41C 3/0014 450/39
2002/0068506 A1 * 6/2002 Devita ..... A41F 1/006 450/1
2004/0221434 A1 * 11/2004 Kaye ..... A41C 3/12 24/714.2
2008/0045122 A1 * 2/2008 Utaka ..... A44B 13/00 450/25
2009/0223029 A1 * 9/2009 Leung ..... A44B 13/0052 24/698.1
2019/0357636 A1 * 11/2019 Utaka ..... F16B 1/00

FOREIGN PATENT DOCUMENTS

CN 201640559 U 11/2010

* cited by examiner

*Primary Examiner* — Gloria M Hale
(74) *Attorney, Agent, or Firm* — Muncy, Geissler, Olds & Lowe, P.C.

(57) ABSTRACT

A clothing back buckle, includes an inner lining cloth, a plurality of fasteners provided on a surface of the inner lining cloth, and an outer sleeve bag sleeved outside the inner lining cloth. The outer sleeve bag is a cylindrical cloth bag with one end open, and first slits corresponding to the fastener and for the fastener to go through are provided on the outer sleeve bag. The clothing back buckle adopts the outer sleeve bag to sleeve outside the inner lining cloth so that the outer sleeve bag completely covers the inner lining cloth. No sharp fracture or firm feel exists on the left and right sides of the clothing back buckle since no sewing seam is provided, the user thus feels more comfortable and harmonious when wearing the bra.

9 Claims, 2 Drawing Sheets

CLOTHING BACK BUCKLE, BRA CONNECTOR AND BRA

CROSS REFERENCE TO RELATED APPLICATION

The present application claims priority from Chinese Patent Applications No. 201910344807.X and 201920595009.X filed on Apr. 26, 2019, all of which are hereby incorporated herein by reference.

TECHNICAL FIELD

The present disclosure relates to the field of clothing, in particular to a clothing back buckle, and a bra connector and a bra applying the clothing back buckle.

BACKGROUND

The existing bra connectors are sewn on the ends of two shoulder-straps, comprising an eye tape and a hook tape which are matched with each other. The structure of the eye tape includes a front side and a rear side. A row or multiple rows of eye buckles are provided on the front side of the eye tape, and the rear side of the eye tape is the surface facing the skin of a body. During the processing of the existing eye tapes, the eye buckles are directly sewn to the eye tape by using fabric tapes, causing that the back of the eye tape leaves rows of sewing seams accordingly, which affects the appearance of bra. Moreover, due to the existence of the sewing seams, the back of a user appears marks in the shape of sewing seam accordingly when wearing the bra, which affects the user experience. Worse still, the user will feel discomfort when the uneven sewing seams touch and rub the skin for a long time, thereby bringing discomfort to the wearer.

CN 2016 40559 U discloses a seamless reverse binding back buckle including a base body having an inner lining cloth and multiple rows of eye buckles. A piece of strip cloth covers the outside of the base body. The front portion of the cloth covers the front side of the base body, and the rear portion of the cloth is reversed to cover the rear side of the base body. The left and right sides of the cloth are connected with the left and right sides of the inner lining cloth by sewing. The sewing opening at the joining portion of the sewing seam is reversely folded to be placed within the inner chamber formed by the cloth. Such back buckle has the advantages of being good in appearance effect and comfortable to wear without damaging the skin. However, both the left and right sides still need to be connected by sewing in the machining process of the seamless reverse binding back buckle. Meanwhile, the sewing opening of the sewing seam needs to be reversely folded to be placed within the inner chamber formed by the cloth. Therefore, more procedures are needed, the left and right sides of the back buckle are thicker than the middle portion, and the wearing feeling of the user is affected.

SUMMARY

The present disclosure thus provides a clothing back buckle without a sewing seam.

According to one aspect of the present invention, there is provided a clothing back buckle comprising an inner lining cloth, a plurality of fasteners provided on a surface of the inner lining cloth, and an outer sleeve bag sleeved outside the inner lining cloth. The outer sleeve bag is a cylindrical cloth bag with one end open, and first slits corresponding to the fastener and for the fastener to go through are provided on the outer sleeve bag.

According to the clothing back buckle described above, the outer sleeve bag is sleeved outside the inner lining cloth to completely cover the inner lining cloth. In addition, the outer sleeve bag is a cylindrical cloth bag with one end open. No sharp fracture or firm feel brought by the sewing seam exists on the left and right sides of the clothing back buckle since no sewing seam is provided, so that the user can feel more comfortable and harmonious when wearing the bra.

The clothing back buckle further includes a hot melt film provided on the surface of the inner lining cloth for bonding the inner lining cloth and the outer sleeve bag. After the outer sleeve bag is sleeved outside the inner lining cloth to cover the inner lining cloth, an ironing machine is used for pressing and flattening, and the hot melt film bonds the inner lining cloth and the outer sleeve bag after being melted by the heat.

According to the clothing back buckle, second slits corresponding to the fastener and for the fastener to go through are provided on the hot melt film without interfering with the fastener to go through.

The fasteners are eye buckles or hook buckles. The fasteners are eye buckles when the clothes back buckle is an eye tape, and are hook buckles when the clothes back buckle is a hook tape.

The fasteners are orderly provided in multiple rows and are orderly arranged.

One or more fasteners are provided in each row.

According to the clothing back buckle described above, the fasteners are sewn on the inner lining cloth.

According to another aspect of the present disclosure, a bra connector is further provided, including an eye tape and a hook tape, in which the eye tape and/or the hook tape adopts the clothing back buckle described above.

According to the bra connector, the clothing back buckle in the bra connector adopts the outer sleeve bag to sleeve outside the inner lining cloth. The outer sleeve bag completely covers the inner lining cloth and is a cylindrical cloth bag with one end open. No sharp fracture or firm feel brought by the sewing seam exists on the left and right sides of the clothing back buckle since no sewing seam is provided, so that the user can feel more comfortable and harmonious when wearing the bra.

According to another aspect of present disclosure, a bra is also provided, including the bra connector described above.

According to the bra described above, the clothing back buckle is provided in the bra connector. The clothing back buckle adopts the outer sleeve bag to sleeve outside the inner lining cloth. The outer sleeve bag completely covers the inner lining cloth and is a cylindrical cloth bag with one end open. No sharp fracture or firm feel brought by the sewing seam exists on the left and right sides of the clothing back buckle since no sewing seam is provided, so that the user can feel more comfortable and harmonious when wearing the bra.

BRIEF DESCRIPTION OF THE DRAWINGS

The present disclosure is further described below with reference to the drawings and embodiments.

DETAILED DESCRIPTION OF EMBODIMENTS

Figure 1:
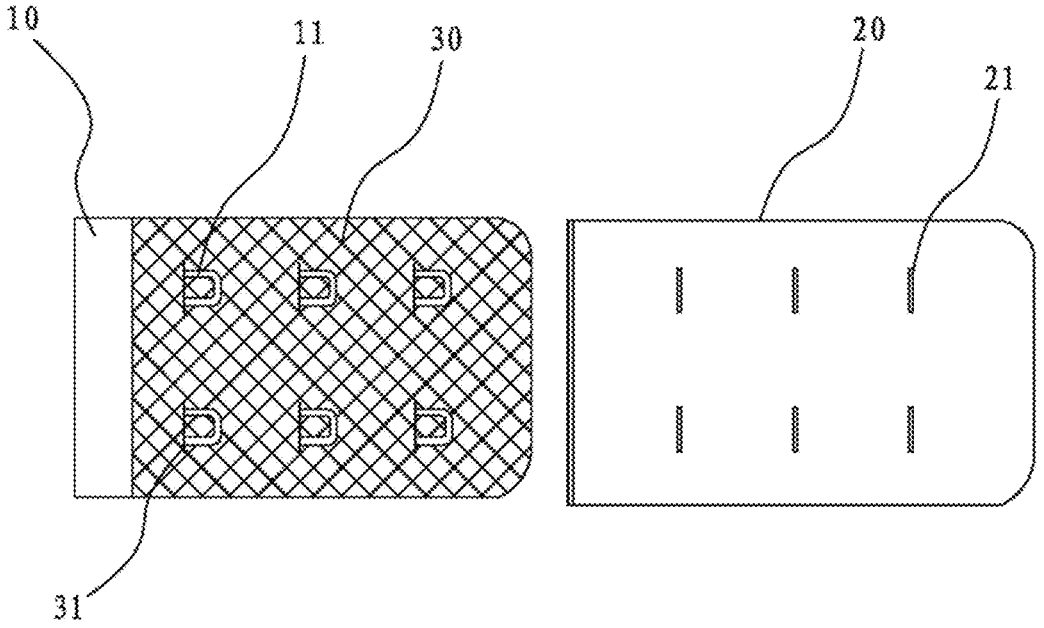
FIG. 1 is a schematic view of the composition and structure of an eye-tape type clothing back buckle.

Embodiments of the present disclosure will be described in detail in this section. The preferred embodiments of the present disclosure are shown in the drawings. The drawings are intended to supplement the written description in the specification, so that people can intuitively and visually understand each technical feature and the overall technical solution of the disclosure. However, it is not to be construed as limiting the scope of the disclosure.

In the description of the present disclosure, it is to be understood that the orientation or positional relationship, indicated as up, down, front, rear, left, right, etc., is based on the orientation or positional relationship shown in the drawings for convenience of describing the present disclosure and simplifying the description only when referring to description of orientation, and is not intended to indicate or imply that the indicated device or element must have a particular orientation or to be configured and operated in a particular orientation. Therefore, these descriptions may not be construed as limiting the disclosure.

In the description of the disclosure, "multiple" means one or more; "more" means more than two; "more than", "less than", and "exceed", etc. are understood to exclude the present number; and "above", "below", "within", etc., are understood to include the present number. Descriptions like first and second are for the purpose of distinguishing the technical features only, and may not be construed as indicating or implying relative importance, or implicitly indicating the number of the indicated technical features, or implicitly indicating a sequential relationship of the indicated technical features.

Among the descriptions of the present disclosure, terms like "set", "mount", "connect" should be understood broadly unless otherwise explicitly stated. Those skilled in the art may reasonably determine the particular meanings of the above words in the present disclosure with reference to specific contents of the technical solution.

Figure 2:
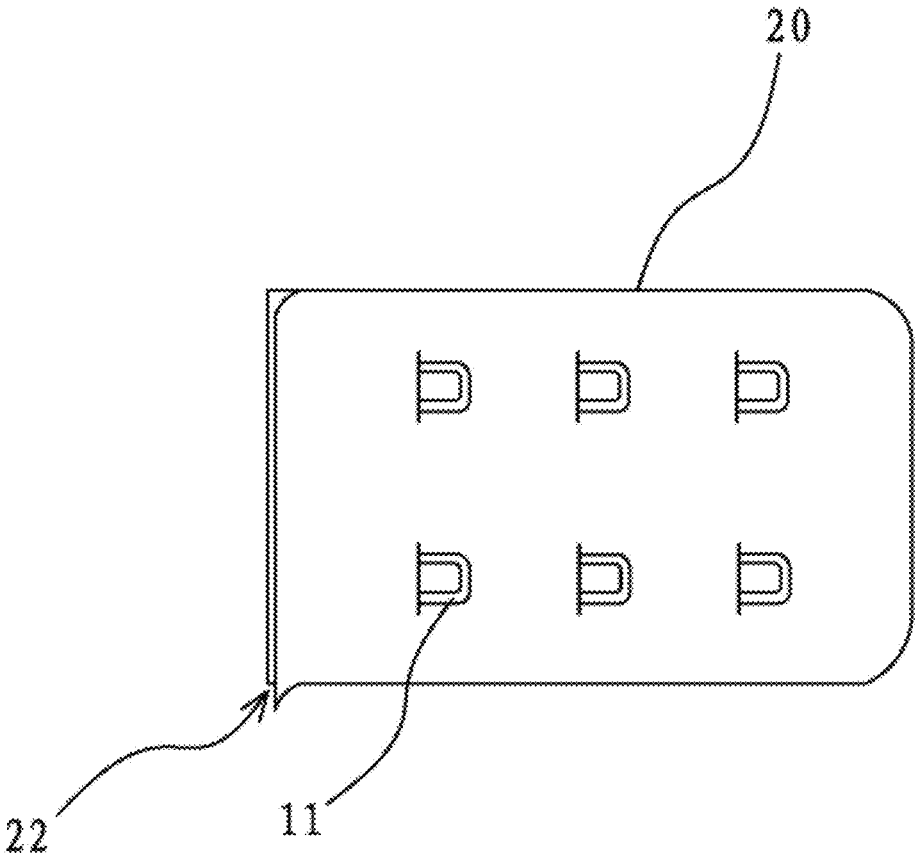
FIG. 2 is a structural schematic view of the eye-tape type clothing back buckle of FIG. 1 in combination.

Referring to FIG. 1, the embodiment provides a back buckle for eye-tape type clothing comprising an inner lining cloth 10 as a carrier, multiple eye buckles 11 sewn on the inner lining cloth 10, and an outer sleeve bag 20 sleeved outside the inner lining cloth 10. The outer sleeve bag 20 is a cylindrical cloth bag with one end open, and multiple first slits 21 corresponding to the eye buckles 11 are provided in the outer sleeve bag 20. Referring to FIG. 2, the outer sleeve bag 20 is sleeved outside the inner lining cloth 10, and the eye buckles 11 go through the first silts and are exposed outside.

Referring to FIG. 1, in order to connect and fasten the inner lining cloth 10 and the outer sleeve bag 20 without sewing, the surface of the inner lining cloth 10 is also provided with a layer of hot melt film 30. Second slits 31 corresponding to the eye buckles 11 are provided in the hot melt film 30 without interfering with the eye buckles 11 to go through. After the outer sleeve bag 20 is sleeved outside the inner lining cloth 10 to cover the inner lining cloth 10, an ironing machine is used to press and flatten the clothing back buckle, and the hot melt film bonds the inner lining cloth 10 and the outer sleeve bag 20 after being melted by the heat form the ironing machine. Therefore, no sewing seam is required and sharp edge or rough surface is avoided.

In addition, it will be appreciated that the eye buckles 11 are provided with multiple rows and are orderly arranged, and the number of the eye buckles 11 is between one and four in each row, so that a user can select different eye buckles 11 for fastening as required.

Referring to FIG. 2, the clothing back buckle provided by the present embodiment needs to be connected to the clothes before use, so that a slit opening 22 is provided at the lower hem of the clothing back buckle using ultrasonic waves to connect the main body of the clothes.

The eye-tape type clothing back buckle of the present embodiment is produced by the following steps:

a) sewing a base body of the back buckle: three rows of ring buckle are sewn on the inner lining cloth;

b) ironing and attaching a hot melt film: the hot melt film is placed on the surface of the inner lining cloth with the sewn ring buckle, and is bonded to the surface of the inner lining cloth after being pressed by the ironing machine;

c) cutting openings on the hot melt film: the front portion of the hot melt film are provided with the second slits corresponding to the positions of the ring buckle with the same number after the hot melt film is pressed and bonded, and the eye buttons go through from the second slits;

d) using ultrasonic wave to hot cut two round corners: the inner lining cloth and the hot melt film are subjected to ultrasonic waves to be hot cut into block units, and two round corners are hot cut out on the two front sides at the same time;

e) making the outer sleeve bag and openings: cylindrical cloth strips are obtained by mechanical weaving and are die-cut into multiple outer sleeve bags by using ultrasonic waves, and first slits corresponding to the positions of the eye buttons with the same number are defined using laser on the outer sleeve bag;

f) sleeving the bag: the outer sleeve bag is sleeved outside the inner lining cloth, and the eye buckles of the inner lining cloth go through from the corresponding first slits to form a sleeve bag full-binding back buckle;

g) pressing and flattening: the full-binding back buckle is pressed and flattened after being sleeved within the sleeve bag by using the ironing machine, the hot melt film is melted to bond the inner lining cloth and the outer sleeve bag as a whole to prevent from falling off, so that the base body produced from the inner lining cloth is covered within the outer sleeve bag and the eye buckles are exposed from the front side; and h) slitting the hem circle: a slit opening is defined at the lower hem of the obtained clothing back buckle using ultrasonic waves to prepare for connecting the main body of the clothes when sewing the clothes after completing the above processes.

The clothing back buckle in the present embodiment adopts the outer sleeve bag to sleeve outside the inner lining cloth. The outer sleeve bag completely covers the inner lining cloth and is a cylindrical cloth bag with one end open. No sewing seam is provided and the procedure is simplified. Meanwhile, no sharp fracture or firm feel brought by the sewing seam exists on the left and right sides of the produced eye-tape type clothing back buckle, so that the user can feel more comfortable and harmonious when wearing the bra.

Figure 3:
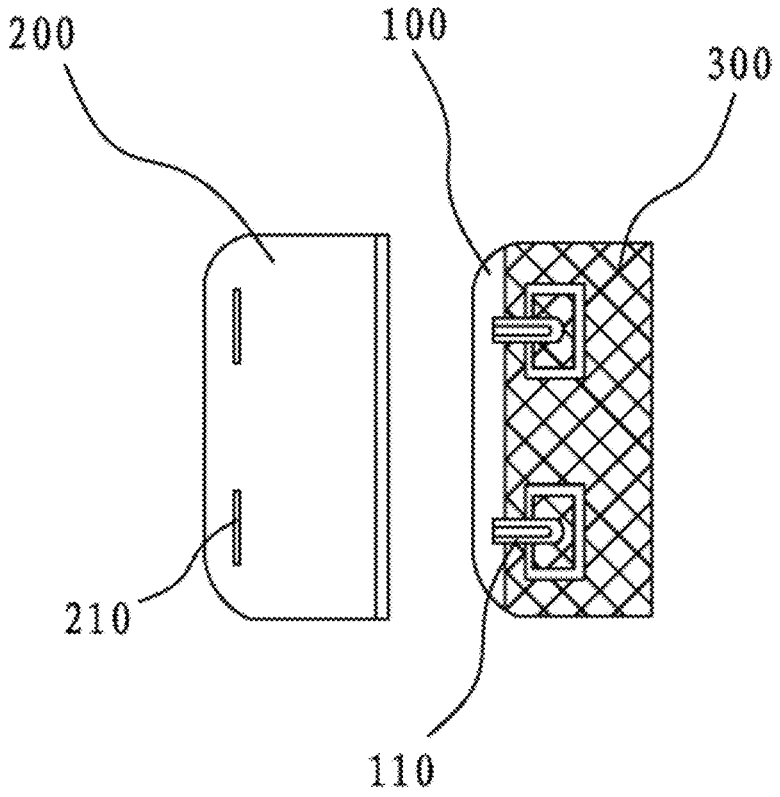
FIG. 3 is a schematic view of the composition and structure of a hook-belt type clothing back buckle.
Figure 4:
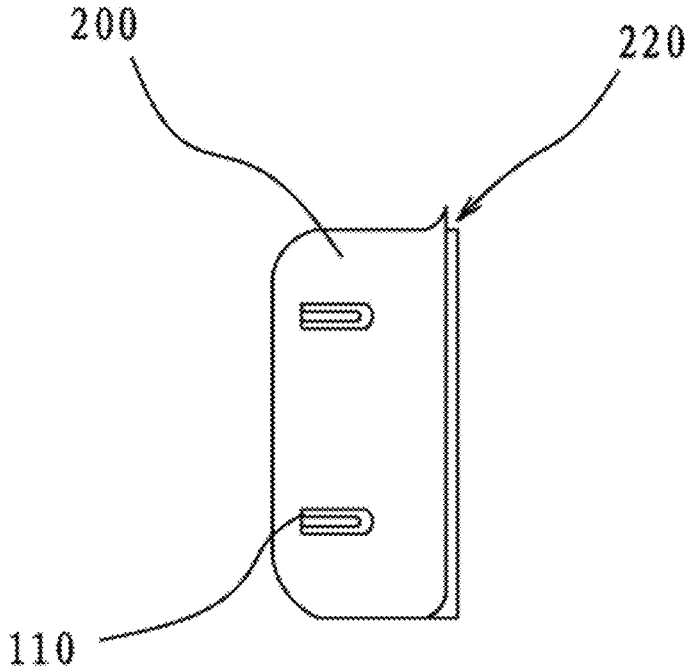
FIG. 4 is a structural schematic view of the hook-belt type clothing back buckle of FIG. 3 in combination.

Referring to FIG. 3, the embodiment provides a back buckle for hook-belt type clothing, including an inner lining cloth 100 as a carrier, multiple hook buttons 110 sewn on the inner lining cloth 100 and an outer sleeve bag 200 sleeved outside the inner lining cloth 100. The outer sleeve bag 200 is a cylindrical cloth bag with one end open, and multiple first slits 210 corresponding to the hook buttons 110 are provided on the outer sleeve bag 200. Referring to FIG. 4, the outer sleeve bag 200 is sleeved outside the inner lining cloth 100, and the hook buttons 110 go through the first slits and are exposed outside.

In the present embodiment, a layer of hot melt film 300 is also provided on the surface of the inner lining cloth 100 for bonding the inner lining cloth 100 and the outer sleeve bag 200. In addition, in the present embodiment, a slit opening 220 is also provided at the lower hem of the clothing back buckle using ultrasonic waves for connecting the main body of the clothes.

It is readily appreciated that the above clothing back buckles according to the embodiments respectively can be used to produce eye tape and hook tape of the bra connector. The eye buckles on the eye tape cooperate with the hook buckles on the hook tape for fastening connection. The bra produced with the above-mentioned bra connector enables the user to feel more comfortable and harmonious when wearing the bra since no sharp fracture or firm feel brought by the sewing seam exists on the left and right sides of the clothing back buckle.

The above descriptions are only preferred embodiments of the present disclosure, and the disclosure is not limited to the above embodiments. Any embodiment falls into the scope of the present disclosure as long as the embodiment achieves the technical effect of the present disclosure by the same means.

The invention claimed is:

1. A clothing back buckle, comprising:

an inner lining cloth;

a plurality of fasteners provided on a surface of the inner lining cloth; and an outer sleeve bag sleeved outside the inner lining cloth, wherein the outer sleeve bag is designed as a cylindrical cloth bag with one end open, the cylindrical cloth bag, which is without sewing seam, is obtained from cylindrical cloth strips made by mechanical weaving, and first slits corresponding to the fasteners and for the fasteners to go through are provided on the outer sleeve bag, wherein a hot melt film is provided on the surface of the inner lining cloth for bonding the inner lining cloth and the outer sleeve bag.

2. The clothing back buckle according to claim 1, wherein second slits corresponding to the fastener and for the fastener to go through are provided on the hot melt film.

3. The clothing back buckle according to claim 1, wherein the fasteners are eye buckles or hook buckles.

4. The clothing back buckle according to claim 3, wherein the fasteners are provided in multiple rows and are orderly arranged.

5. The clothing back buckle according to claim 4, wherein one or more fasteners are provided in each row.

6. The clothing back buckle according to claim 3, wherein the fasteners are sewn on the inner lining cloth.

7. A bra connector, comprising an eye tape and a hook tape, wherein the eye tape and/or the hook tape adopt the clothing back buckle according to claim 1.

8. A bra, comprising the bra connector according to claim 7.

9. The clothing back buckle according to claim 1, wherein a slit opening is provided at the end open.

* * * * *